US009527312B2

(12) United States Patent
Hara et al.

(10) Patent No.: US 9,527,312 B2
(45) Date of Patent: Dec. 27, 2016

(54) LIQUID DISCHARGING APPARATUS

(71) Applicant: SEIKO EPSON CORPORATION, Tokyo (JP)

(72) Inventors: Osamu Hara, Matsumoto (JP); Shuichiro Nakano, Matsumoto (JP); Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/594,505

(22) Filed: Jan. 12, 2015

(65) Prior Publication Data

US 2015/0202893 A1 Jul. 23, 2015

(30) Foreign Application Priority Data

Jan. 17, 2014 (JP) ..... 2014-006936

(51) Int. Cl.
*B41J 11/00* (2006.01)

(52) U.S. Cl.
CPC ..... *B41J 11/002* (2013.01); *B41J 11/0095* (2013.01)

(58) Field of Classification Search
CPC ..... B41J 11/002; B41J 2/125; B41J 11/0095; B41J 2/14145; G02B 21/362; G02B 21/364
USPC ..... 347/102
See application file for complete search history.

(56) References Cited

U.S. PATENT DOCUMENTS

| | | | | |
|---|---|---|---|---|
| 4,540,990 | A * | 9/1985 | Crean | B41J 2/125 347/19 |
| 4,933,684 | A * | 6/1990 | Tasaki | B41J 11/002 346/25 |
| 6,290,351 | B1 * | 9/2001 | Merz | 347/104 |
| 6,582,051 | B2 * | 6/2003 | Bruch | B41J 29/393 347/19 |
| 7,001,089 | B2 * | 2/2006 | Tozaki | B41J 2/32 347/222 |
| 8,740,326 | B2 * | 6/2014 | Korogi | B41J 11/002 347/101 |
| 2005/0012778 | A1 * | 1/2005 | Nishino | B41J 11/002 347/29 |
| 2007/0097195 | A1 * | 5/2007 | Nishino | 347/102 |
| 2007/0138418 | A1 * | 6/2007 | Sasa | 250/559.01 |
| 2008/0024557 | A1 * | 1/2008 | Moynihan | 347/56 |
| 2008/0079795 | A1 * | 4/2008 | Nakazawa | 347/102 |
| 2008/0231646 | A1 * | 9/2008 | Sugahara | B41J 2/195 347/6 |

(Continued)

FOREIGN PATENT DOCUMENTS

| | | |
|---|---|---|
| JP | 07-215523 | 8/1995 |
| JP | 2009-251408 | 10/2009 |
| JP | 2013-151149 | 8/2013 |

*Primary Examiner* — Matthew Luu
*Assistant Examiner* — Patrick King
(74) *Attorney, Agent, or Firm* — Workman Nydegger

(57) ABSTRACT

A liquid discharging apparatus includes a discharge unit that is capable of discharging a liquid, a medium support unit in which an opening portion is provided, and which supports a medium onto which the liquid is discharged, a heater that is capable of applying heat to the medium, a sensor that detects an energy in a detectable region, a control unit that is capable of changing an output of the heater on the basis of the energy, and a detectable portion whose energy is detected by the sensor, and which is provided in a position that is within the opening portion and is within the detectable region.

11 Claims, 8 Drawing Sheets

(56) References Cited

U.S. PATENT DOCUMENTS

| | | | | |
|---|---|---|---|---|
| 2009/0231404 | A1* | 9/2009 | Niekawa | B41J 11/20 347/102 |
| 2012/0162335 | A1* | 6/2012 | Sasaki | 347/102 |
| 2013/0015285 | A1* | 1/2013 | Uruma | B65H 18/103 242/420.5 |
| 2013/0044153 | A1* | 2/2013 | Sasaki et al. | 347/16 |
| 2013/0083135 | A1* | 4/2013 | Kasiske, Jr. | B41J 11/002 347/73 |
| 2013/0162742 | A1 | 6/2013 | Inoue et al. | |
| 2014/0092185 | A1* | 4/2014 | Oki | B41J 11/002 347/102 |

* cited by examiner

FIG. 9

| | MATERIAL | RADIATIVE RATE |
|---|---|---|
| MEDIUM A | ACRYL RESIN | 0.80 |
| MEDIUM B | ACRYL RESIN | 0.83 |
| MEDIUM C | PET RESIN | 0.85 |
| MEDIUM D | PET RESIN | 0.87 |
| MEDIUM E | VINYL CHLORIDE RESIN | 0.90 |
| MEDIUM F | VINYL CHLORIDE RESIN | 0.90 |
| MEDIUM G | VINYL CHLORIDE RESIN | 0.91 |
| MEDIUM H | CLOTH | 0.92 |
| MEDIUM I | PAPER | 0.94 |
| MEDIUM J | CLOTH | 0.95 |
| MEDIUM K | PAPER | 0.95 |

LIQUID DISCHARGING APPARATUS

BACKGROUND

1. Technical Field

The present invention relates to a liquid discharging apparatus such as an ink jet printer.

2. Related Art

Liquid discharging apparatuses that include a head that discharges a liquid such as ink onto a medium, a medium support unit that supports the medium, and a heater that applies heat by irradiating a medium that is supported by the medium support unit with electromagnetic waves such as infrared rays, thereby curing the liquid, are already known (refer to Japanese Unexamined Patent Application Publication No. 2009-251408).

In addition, there are cases in which a liquid discharging apparatus is provided with an infrared sensor that detects infrared rays that are emitted from a surface of a medium by sensing the surface of the medium within a heat application range of the heater. The infrared sensor is a constituent member for obtaining temperature information of the surface of the medium. Further, in such a case, a controller controls an output of the heater on the basis of energy (temperature information) that is detected by the infrared sensor.

In a case in which there is not a medium on the configuration or in a sensing point, the abovementioned infrared sensor senses a surface of the medium support unit. Further, in such a case, a state of the sensing point differs from when the surface of the medium is sensed. Therefore, it is not possible to suitably control an output of the heater when there is not a medium at the sensing point.

SUMMARY

An advantage of some aspects of the invention is to provide a liquid discharging apparatus in which a case in which there is a medium on a sensing point, and a case in which there is not a medium on the sensing point arise, where an output of a heater is suitably controlled even in a case in which there is not a medium.

According to an aspect of the invention, there is provided a liquid discharging apparatus including a discharge unit that is capable of discharging a liquid, a medium support unit in which an opening portion is provided, and which supports a medium onto which the liquid is discharged, a heater that is capable of applying heat to the medium, a sensor that detects an energy in a detectable region, a control unit that is capable of changing an output of the heater on the basis of the energy, and a detectable portion whose energy is detected by the sensor, and which is provided in a position that is within the opening portion and is within the detectable region.

In this case, using the detectable portion that is provided in a position that is within the opening portion and is within the detectable region, it is possible to suitably control an output of the heater even in a case in which there is not a medium at the sensing point.

In the liquid discharging apparatus, a emissivity of the detectable portion may be 0.7 or more and below 1.

The emissivities of the majority of normal media fall within a range of 0.7 or more and below 1.

In this case, since the emissivity of the detectable portion is 0.7 or more and below 1, it is possible to suitably control the output of the heater even in a case in which there is not a medium at the sensing point.

In the liquid discharging apparatus, a difference between a emissivity of the detectable portion and a emissivity of the medium may be within 0.1.

In this case, since the difference between the emissivity of the detectable portion and the emissivity of the medium is within 0.1, it is possible to suitably control the output of the heater even in a case in which there is not a medium at the sensing point.

In the liquid discharging apparatus, the detectable portion may be an aluminum to which an alumite treatment has been applied.

The emissivity of aluminum is considerably lower than that of the medium which is approximately 0.1, but by applying an alumite treatment to the surface thereof, it is possible to considerably increase the emissivity of the surface thereof. As a result of this, it is possible to reduce a difference (a emissivity difference) between the emissivity of the detectable portion and the emissivity of the medium. Additionally, the alumite treatment itself may use a publicly-known treatment method.

In this case, it becomes possible to suitably control the output of the heater using a simple method such as an alumite treatment while benefiting from the additional advantage of using a material with high strength such as a metal as the medium support unit.

In the liquid discharging apparatus, the detectable portion may be provided in a position which is in the medium support unit and does not configure a support surface of the medium support.

In this case, since the detectable portion does not come into contact with the medium, it is even possible to reduce a concern that the medium will become stained in a case in which condensation is generated in the detectable portion.

In the liquid discharging apparatus, a linear member that regulates an approach of the medium in a direction that the medium is coming into contact with the detectable portion, may be provided in the opening portion.

In this case, due to the presence of the linear member, it is possible to reduce a concern that the medium will approach and become caught in the opening portion.

In the liquid discharging apparatus, the medium may be capable of being transported in a transport direction, and a length of a side of the opening portion in a direction that runs along the transport direction of the medium may be 5 mm or less.

In this case, it is possible to control a circumstance in which lines are formed on a printed object (for example, an image) that is formed on the medium.

In the liquid discharging apparatus, the medium may be capable of being transported in a transport direction, and a length of a side of the opening portion in a direction that is orthogonal to the transport direction of the medium may be 5 mm or less.

In this case, it is possible to reduce a concern that the medium will become caught in the opening portion during transport of the medium.

In the liquid discharging apparatus, the opening portion may be formed by bending a portion of the medium support unit in the form of a mountain fold when viewed from a side that supports the medium.

In this case, it is possible to reduce a concern that a medium that is transported will become caught at the edge of the opening portion.

In the liquid discharging apparatus, there may be cases in which the sensor detects an energy of the detectable portion, and cases in which the sensor detects an energy of the medium that is supported by the medium support unit.

In this case, it becomes possible to suitably control the output of the heater even in a state in which the sensor senses the detectable portion.

In the liquid discharging apparatus, a size of the detectable region may be variable, and the size of the detectable region may change as a result of cases in which the sensor detects an energy of the detectable portion, and cases in which the sensor detects an energy of the medium that is supported by the medium support unit.

In this case, it is possible to realize suitable heater control depending on a state of the sensing point.

BRIEF DESCRIPTION OF THE DRAWINGS

The invention will be described with reference to the accompanying drawings, wherein like numbers reference like elements.

FIG. 9 is a view of a table in which the emissivities of media are shown.

DESCRIPTION OF EXEMPLARY EMBODIMENTS

Figure 1:
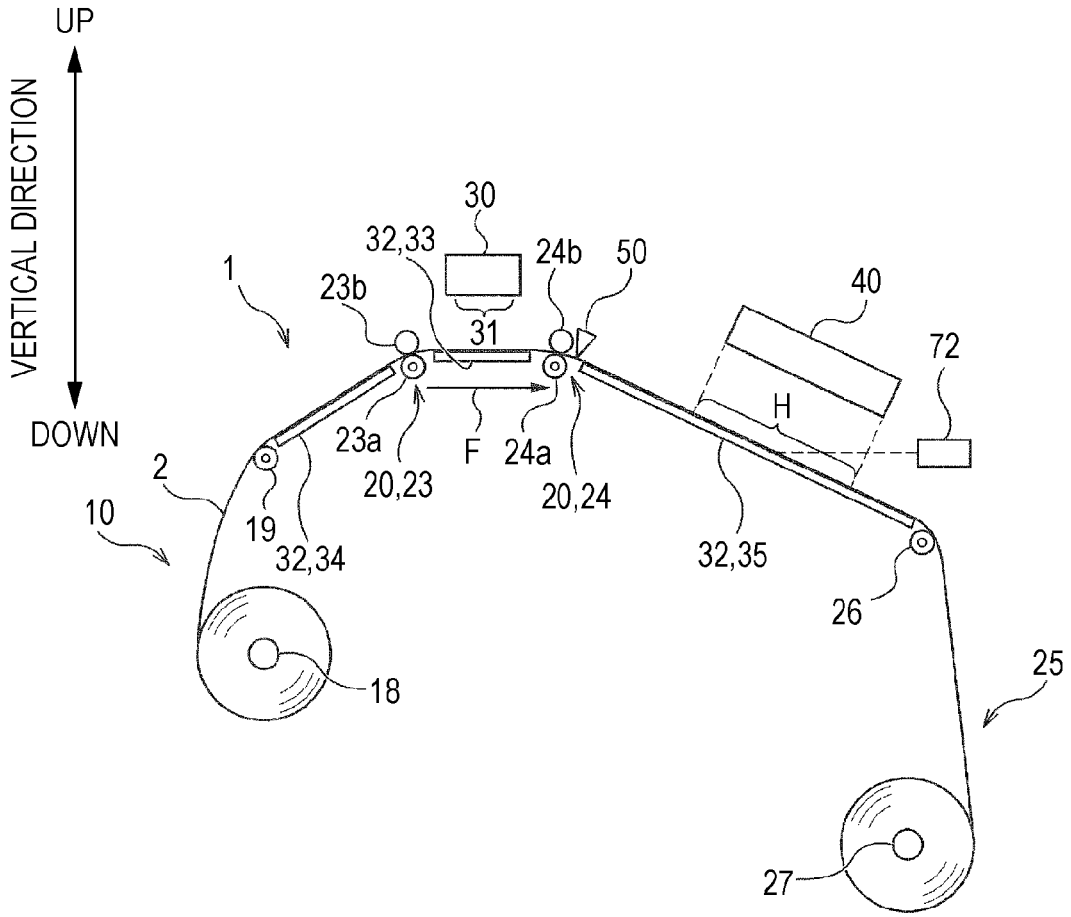
FIG. 1 is an overall configuration schematic drawing of an embodiment of a liquid discharging apparatus according to the invention.
Figure 2:
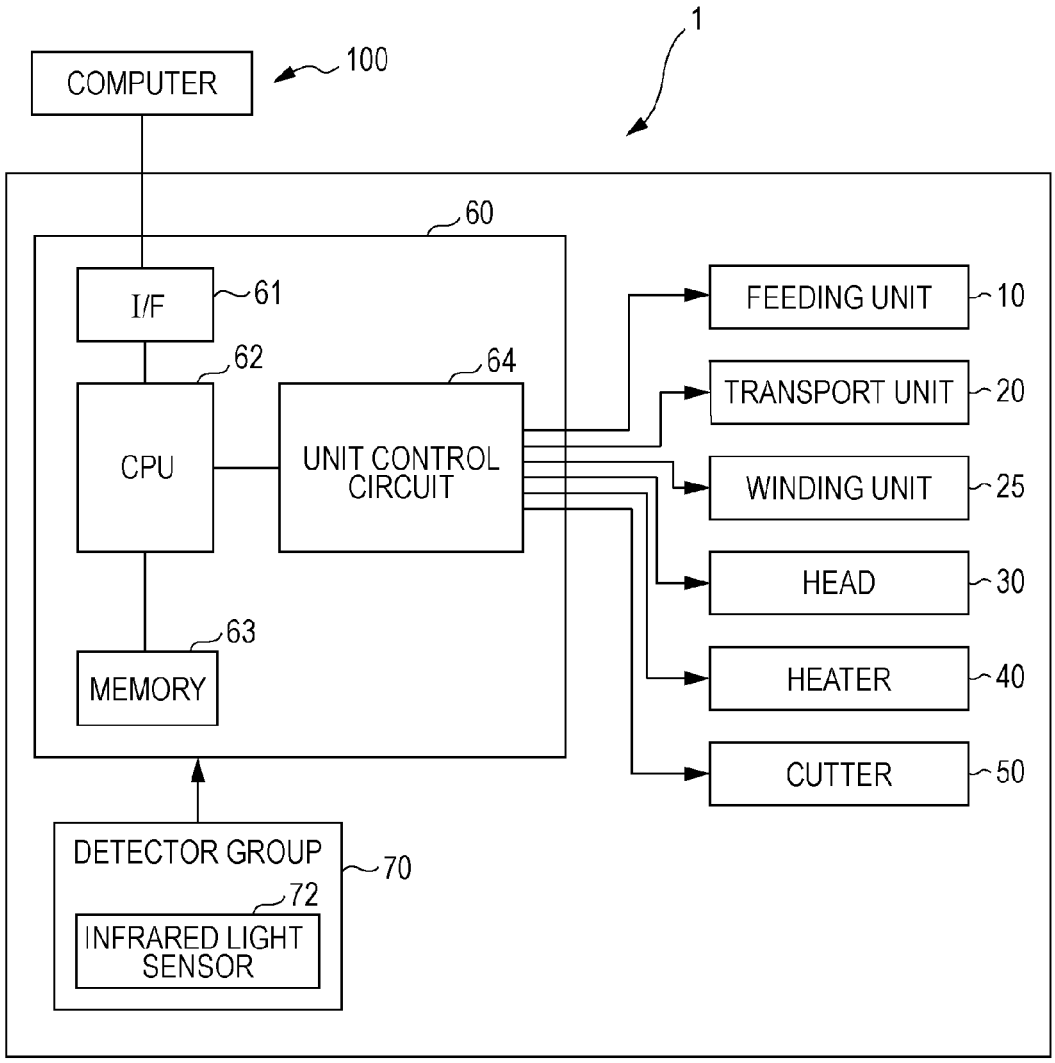
FIG. 2 is a block diagram of the entire configuration of the same embodiment as above.

(1) Overall Configuration of Liquid Discharging Apparatus (Refer to FIG. 1 and FIG. 2)

FIG. 1 is a schematic view in which a configuration example of an ink jet printer (hereinafter, simply referred to as a printer) 1 is shown as an example of the liquid discharging apparatus according to the invention. FIG. 2 is a block diagram of the entire configuration of the printer 1.

As shown in FIG. 1 and FIG. 2, the printer 1 according to the present embodiment is provided with a head 30 that discharges ink as a liquid L onto a roll-shaped medium 2, a medium support unit 32 that supports the medium 2, a heater 40 that is capable of applying heat to the medium 2 that is supported by the medium support unit 32 by irradiating the medium 2 with electromagnetic waves, a sensor 72 that obtains temperature information by performing sensing, and a control unit 60 that controls an output of the heater 40 on the basis of the temperature information that the sensor 72 obtains. Furthermore, the printer 1 includes a feeding unit 10, a transport unit 20, a winding unit 25 a cutter 50 and a detector group 70.

The feeding unit 10 is a unit that feeds the roll-shaped medium 2 as an example of a medium to the transport unit 20. As shown in FIG. 1, the feeding unit 10 includes a medium winding axis 18 on which the medium 2 is wound and rotatably supported, and a relay roller 19 for guiding the medium 2 that is delivered out from the medium winding axis 18 to the transport unit 20 by starting winding thereof.

The transport unit 20 is a unit that transports the medium 2 that is sent by the feeding unit 10 in a transport direction F along a transport route that is set in advance. As shown in FIG. 1, the transport unit 20 includes a first transport roller 23 and a second transport roller 24 that is positioned on a downstream side in the transport direction F when viewed from the first transport roller 23.

The first transport roller 23 includes a first driving roller 23*a* that is driven by a motor (not shown in the drawings), and a first driven roller 23*b* that is positioned so as to oppose the first driving roller 23*a* with the medium 2 interposed therebetween.

In the same manner, the second transport roller 24 includes a second driving roller 24*a* that is driven by a motor (not shown in the drawings), and a second driven roller 24*b* that is positioned so as to oppose the second driving roller 24*a* with the medium 2 interposed therebetween.

The winding unit 25 is a unit that winds the medium (medium 2 upon which image recording has been completed) that is delivered from the transport unit 20.

As shown in FIG. 1, the winding unit 25 includes a relay roller 26 for transporting the medium 2 that is delivered from the second transport roller 24 from an upstream side in the transport direction F toward the downstream side in the transport direction by starting winding thereof, and a medium winding driving axis 27, which is rotatably supported, and which winds the medium 2 that is delivered from the relay roller 26.

The head 30 is a unit for recording an image by discharging ink onto the medium 2 that is positioned in an image recording region of the transport route.

That is, as shown in FIG. 1, the head 30 forms an image on the medium 2 that is delivered onto a platen 33 (to be described later) by the transport unit 20 by discharging ink as an example of the liquid L from ink discharge nozzle 31. In other words, the head 30 functions as a discharge unit that is capable of discharging the liquid L.

Additionally, a piezo element (not shown in the drawings) is provided in the ink discharge nozzle 31 as a driving element for discharging ink droplets. When a voltage is applied between electrodes that are provided at both ends of the piezo element at a predetermined timing, the piezo element expands depending on the application time of the voltage, and deforms a side wall of an ink flow channel. As a result of this, a volume of the ink flow channel is contracted depending on the expansion and contraction of the piezo element, and ink that corresponds to this amount of contraction becomes ink droplets and is discharged from the ink discharge nozzle 31.

The medium support unit 32 is a unit for supporting the medium 2 from below. The medium support unit 32 is made from a metal, and more specifically, is made from aluminum.

As shown in FIG. 1, in the present embodiment, the platen 33 that opposes the head 30, an upstream side support member 34 that is positioned on the upstream side of the platen 33 in the transport direction, and a downstream side support member 35 that is positioned on the downstream side of the platen 33 in the transport direction are provided as the medium support unit 32.

The heater 40 is a component for curing ink by applying heat to the medium 2, or in other words, ink that is on the medium 2.

As shown in FIG. 1, the heater 40 is an infrared heater that irradiates infrared rays, and is provided in a position that opposes the downstream side support member 35. That is, the heater 40 irradiates infrared rays toward the medium 2 that is supported by the downstream side support member 35, or in other words, the heater 40 is capable of applying heat to the medium 2.

The cutter 50 is a component for cutting the medium 2. The cutter 50 detaches the medium 2 upon which image recording has been completed from the medium 2 upon which image recording is yet to be performed by cutting the medium 2 when a non-winding mode (to be described later) is executed.

As shown in FIG. 1, the cutter 50 is provided between the head 30 and the heater 40 in a transport direction F.

In addition, as shown in FIG. 2, the printer 1 is provided with the control unit 60 that manages the operations of the printer 1 by controlling the abovementioned units and the like, and the detector group 70. The printer 1 that has received a recording execution instruction from a computer 100, which is an external apparatus, controls each unit, the feeding unit 10, the transport unit 20, the winding unit 25, the head 30, the heater 40 and the cutter 50 using the control unit 60. The control unit 60 controls each unit and records an image on the medium 2 on the basis of data of the recording execution instruction that is received from the computer 100.

A status inside the printer 1 is monitored by the detector group 70, and the detector group 70 outputs the detection result to the control unit 60. The control unit 60 controls each unit on the basis of the detection result that is output from the detector group 70.

Additionally, as shown in FIG. 1 and FIG. 2, in the printer 1 according to the present embodiment, an infrared sensor 72 is provided as the sensor, which is an example of the detector group 70. The infrared sensor 72 obtains temperature information of the medium 2 by sensing the surface of the medium 2 within a heat application range H of the heater 40, or in other words, an irradiation range (refer to FIG. 1). Temperature information more specifically refers to an energy of a sensing point. Therefore, sensing can also be referred to as detecting energy. In addition, a region in which sensing is performed is referred to as a sensing area. The sensing area can also be called a detectable region. Therefore, in other words, the sensor detects the energy of the detectable region.

Further, it is configured so that an output of the heater 40 is controlled by the control unit 60 on the basis of the temperature information that the infrared sensor 72 obtains. In other words, the control unit 60 is capable of changing the output of the heater 40 on the basis of the energy that the sensor detects.

The control unit 60 is a control unit for performing control of the printer 1. The control unit 60 includes an interface unit 61, a CPU 62, memory 63 and a unit control circuit 64.

The interface unit 61 performs the sending and receiving of data between the computer 100, which is an external apparatus, and the printer 1. The CPU 62 is an arithmetic processing device for performing the control of the entire printer 1. The memory 63 is a component for saving regions that store the programs of the CPU 62, work regions and the like, and includes a storage element such as RAM, which is a volatile memory, EEPROM, which is a non-volatile memory or the like. The CPU 62 controls each unit through the unit control circuit 64 according to the programs that are stored in the memory 63.

(2) Execution Modes of Liquid Discharging Apparatus (Refer to FIG. 1 and FIGS. 3A to 3C)

Next, a winding mode and a non-winding mode, which are execution modes of the printer 1 according to the present embodiment, will be described using FIG. 1 and FIGS. 3A to 3C.

Figure 3A:
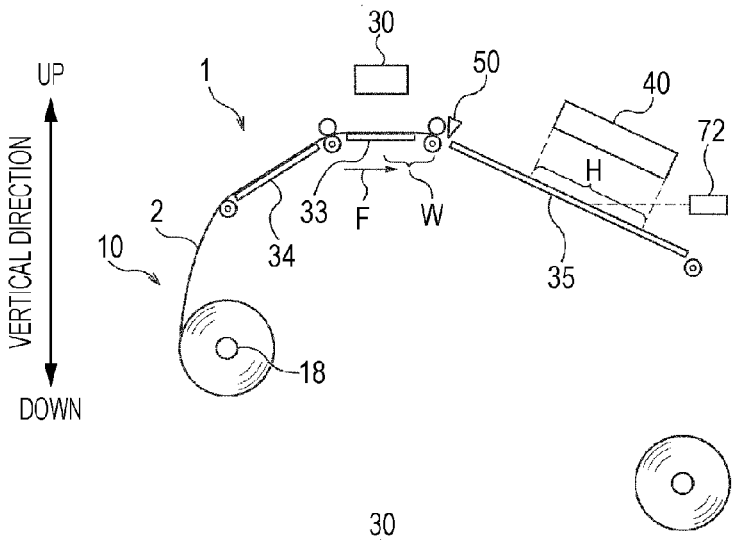
FIGS. 3A to 3C are explanatory drawings for describing a non-winding mode of the same embodiment as above.
Figure 3B:
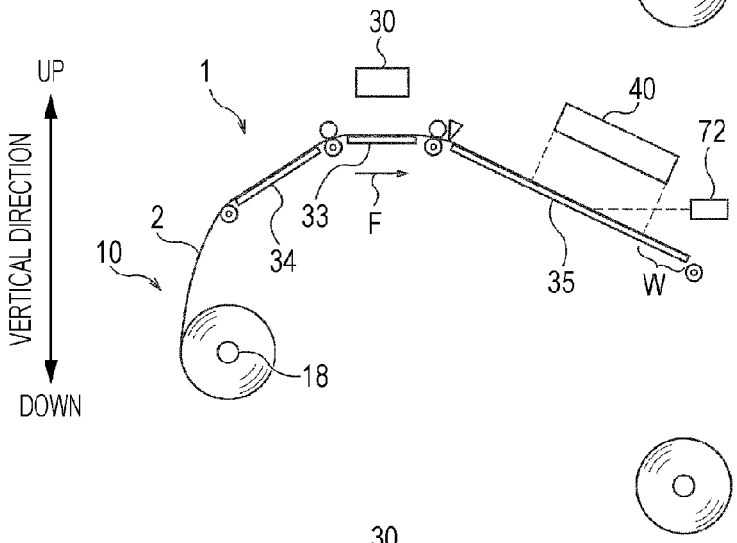
Figure 3C:
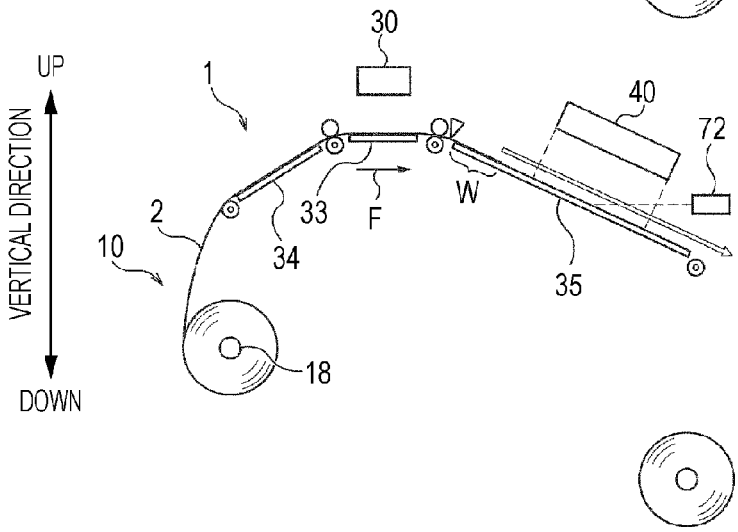

FIGS. 3A to 3C are explanatory drawings for describing the non-winding mode. Additionally, since an aspect in which the winding mode is executed is displayed in FIG. 1, the winding mode will be described with reference to FIG. 1.

The printer 1 according to the present embodiment is provided with a non-winding mode in which the winding unit 25 is not used, and the medium 2 upon which image recording has been completed is not wound by the medium winding driving axis 27, and the winding mode in which the winding unit 25 is used, and the medium 2 upon which image recording has been completed is wound by the medium winding driving axis 27 as execution modes.

That is, the control unit 60 is made so as to execute a winding mode that causes the medium 2 that is transported by the transport unit 20 to be wound by the winding unit 25, and a non-winding mode that causes the medium 2 that is transported by the transport unit 20 not to be wound by the winding unit 25.

Winding Mode

As shown in FIG. 1, when the winding mode is executed, the medium 2 is transported by the transport unit 20 while retaining a wound state on both the feeding unit 10 and the winding unit 25, that is, the medium winding axis 18 and the medium winding driving axis 27.

Further, a part of the medium 2 that is delivered out from the medium winding axis 18 eventually reaches a position that opposes the head 30, and an image is formed on the corresponding part at the corresponding position. When the medium 2 is further transported, the part on which the image was formed eventually reaches a position (the heat application range H) that opposes the heater 40, and infrared rays are irradiated onto the corresponding part at the corresponding position. Further, it is configured such that the corresponding part reaches the winding unit 25 through still further transport of the medium 2, and is wound by the medium winding driving axis 27.

Non-Winding Mode

On the other hand, as shown as an example in FIGS. 3A to 3C, when the non-winding mode is executed, the medium 2 is transported by the transport unit 20 while retaining a wound state on the feeding unit 10 only.

As is shown in FIG. 3A, a part of the medium 2 that is delivered out from the medium winding axis 18 reaches a position that opposes the head 30, and an image is formed on the corresponding part at the corresponding position. In FIG. 3A, the symbol W shows an example of the image formation range on the medium 2.

Next, as is shown in FIG. 3B, the image formation range W reaches a position (the heat application range H) that opposes the heater 40 due to further transport of the medium 2, and infrared rays are irradiated onto the corresponding image formation range W at the corresponding position. FIG. 3B shows a state in which infrared ray irradiation onto the image formation range W has been completed.

Next, as is shown in FIG. 3C, the medium 2 is transported in a reverse direction by the transport unit 20. The image formation range W is returned to just before a position of the cutter 50, and the medium 2 is cut by the cutter 50. Further, as a result of this, the medium 2 upon which image recording has been completed is detached from the medium 2 upon which image recording is yet to be performed, and is moved in the direction of the long white arrow while sliding on the downstream side support member 35.

(3) Explanation of Problem in Non-winding Mode

In the abovementioned manner, in the present embodiment, the cutter 50 is provided in the printer 1, and the present embodiment is configured to be capable of executing the non-winding mode as well as the normal winding mode.

As is shown in FIGS. 3A to 3C, when the non-winding mode is executed, a case in which the medium 2 is positioned on the downstream side support member 35 (FIG. 3B) and a case in which the medium 2 is not positioned on the downstream side support member 35 (FIG. 3A) are caused. As a result of this, there is a possibility that the problem that will be described below will occur.

As mentioned above, when the non-winding mode is executed, the medium 2 may be positioned or may not be positioned on the downstream side support member 35.

In a case in which the medium 2 is positioned on the downstream side support member 35, the infrared sensor 72 senses the surface of the medium 2 within the heat application range H of the heater 40. Further, the control unit 60 controls the output of the heater 40 on the basis of the temperature information that is detected by the infrared sensor 72. Further, as a result of this, the medium 2 is set to a predetermined temperature (approximately 100° C. in the present embodiment).

However, when the medium 2 attains a state of not being positioned on the downstream side support member 35, the medium 2 is not at the sensing point, and in this case, the infrared sensor 72 senses the downstream side support member 35.

That is, the surface of the downstream side support member 35 is sensed by the infrared sensor 72, and output control of the heater 40 is performed on the basis of this sensing result. In other words, it is configured such that there is a case in which the infrared sensor 72 senses the surface of the downstream side support member 35, and a case in which the infrared sensor 72 senses a medium that is supported by the medium support unit.

Further, if a situation when the medium 2 is at the sensing point is set as a first state and a state in which the medium 2 is not at the sensing point is set as a second state, in the second state, a status of the sensing point is different from when the surface of the medium 2 is sensed. For example, the status of the sensing point becomes states in which the first state is paper and the second state is metal. Therefore, output control of the heater 40 that is the same as the first state, that is, such as that when the surface of the medium 2 is sensed is not possible. Therefore, when a state in which the medium 2 is positioned on the downstream side support member 35 is attained from the second state, or in other words, when the medium 2 reaches the downstream side support member 35, a problem in that the output of the heater 40 has not reached an output for setting the medium 2 to the predetermined temperature, occurs.

Therefore, it is desirable that, in a state in which there is not a medium 2 at the sensing point, the output control of the heater 40 also be executed in a manner such as that when there is a medium 2 at the sensing point. If this is the case, when a state in which the medium 2 is positioned on the downstream side support member 35 is attained from the second state, the output of the heater 40 has already reached an output for setting the medium 2 to the predetermined temperature, and the problem is solved.

(4) Measure Applied to Downstream Side Support Member 35

Figure 4:
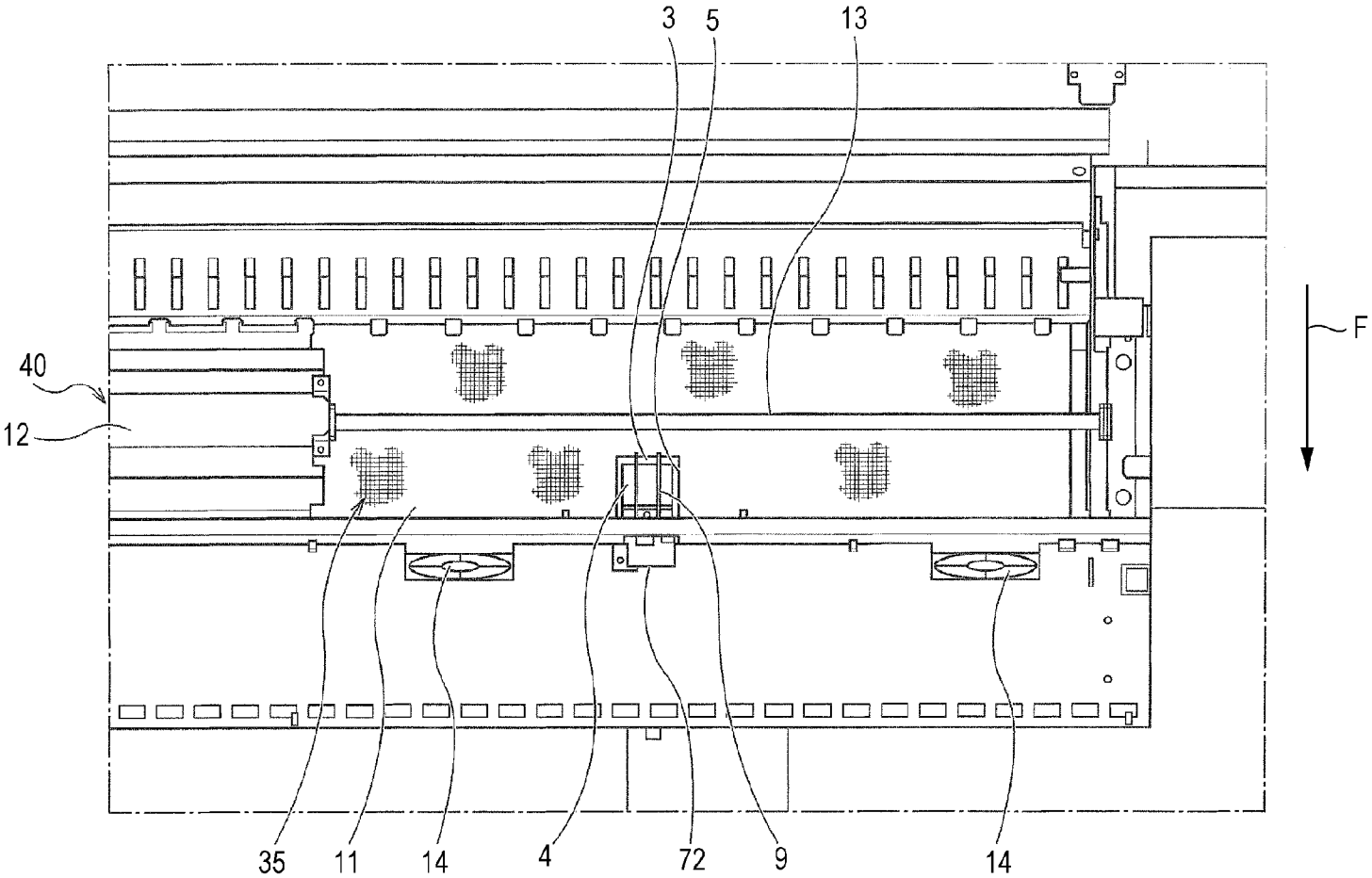
FIG. 4 is a plan view of the main parts of the same embodiment as above.
Figure 5:
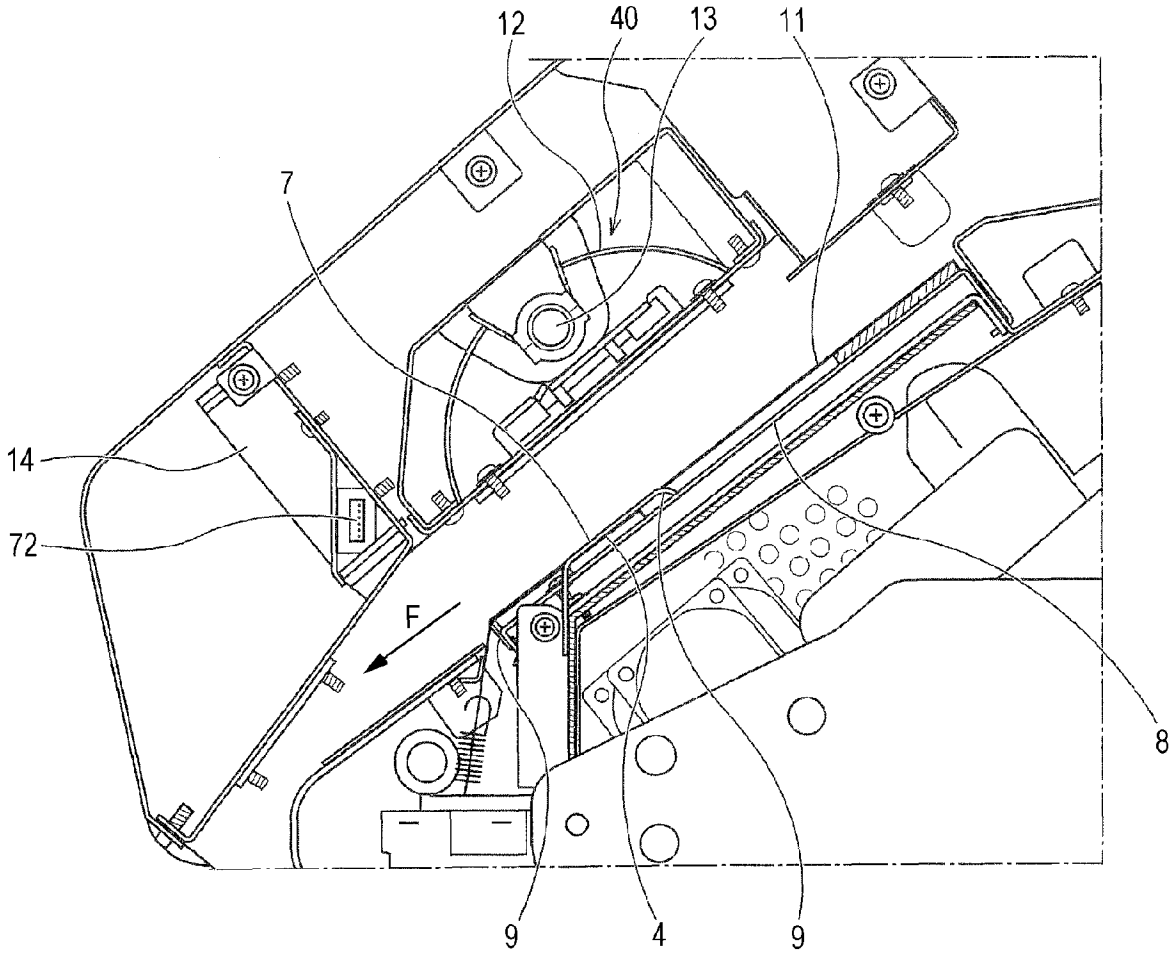
FIG. 5 is a sectional side view of the main parts of the same embodiment as above.
Figure 6:
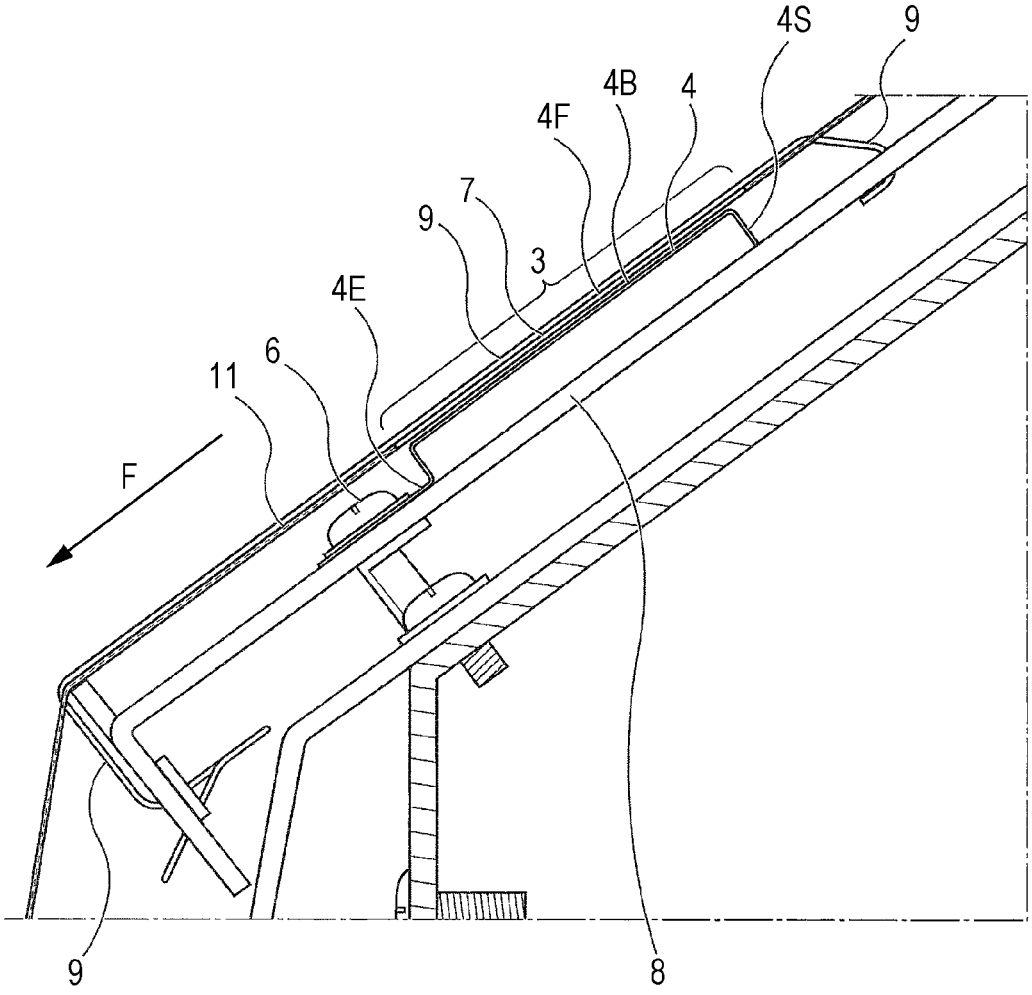
FIG. 6 is an expanded sectional side view of FIG. 5.

As shown in FIGS. 4 to 6, in the present embodiment, since, in a state in which there is not a medium 2 at the sensing point, it is made so that it is also possible to execute sensor output control in a manner such as that when there is a medium 2 at the sensing point, an opening portion 3 is provided in the downstream side support member 35, which is the medium support unit 32, and a detectable portion 4 that is sensed by the sensor 72 is provided inside the opening portion 3. In other words, the opening portion 3 is provided in the medium support unit 32, and the medium support unit 32 supports the medium 2 on which liquid L is discharged. In addition, the detectable portion 4 is provided in a position that is within the opening portion 3, and is within the detectable region. Further, the energy of the detectable portion 4 is detected by the infrared sensor 72.

In the present embodiment a support surface 11 of the downstream side support member 35, that supports the medium 2 by coming into contact with the medium 2, is configured by a meshed member. A mesh is created by a wire rod with a size of 1 mm or less, and a size of the mesh, that is, small openings that penetrate through the support surface 11 from a front surface to a rear surface, is 1 mm or less. Naturally, the mesh is not limited to a mesh with these dimensional configurations. The opening portion 3 is provided in the mesh that forms the support surface 11.

In this instance, the detectable portion 4 being positioned inside the opening portion 3 refers to the fact that the detectable portion 4 is positioned inside the opening portion 3 independently of the downstream side support member (the medium support unit 32) 35. That is, the detectable portion 4 is provided separately from the downstream side support member 35 in a position that is surrounded by a peripheral edge portion 5 that makes the opening portion 3 of the downstream side support member 35. In the present embodiment, the opening portion 3 is formed to be rectangular.

As a result of the abovementioned configuration, it is even possible to suitably control the output of the heater 40 in a case in which there is no medium 2 at the sensing point. In addition, since the detectable portion 4 is positioned in the opening portion 3 independently of the downstream side support member 35, that is, the mesh that forms the support surface 11, it is possible to realize a state in which there is very little heat transfer of heat energy, which is applied to the detectable portion 4 from the heater 40, to the support surface 11 and the downstream side support member 35. As a result of this, the output of the heater 40 becomes an output that is sufficient to apply heat to the detectable portion 4. That is, it becomes possible to cut down on the output (the heat energy) of the heater 40 by an amount that corresponds to heat transfer to a downstream side support member 35 side, and therefore, it becomes possible to suitably control the output of the heater 40 by cutting down on waste.

Furthermore, in the present embodiment, the detectable portion 4 is made from a material which causes a emissivity of the detectable portion 4 to become 0.7 or more and below 1. Since the emissivities of a great deal of normal media 2 fall within a range of 0.7 or more and below 1, matching of the emissivity of the detectable portion 4 and the emissivity of the medium 2 is performed.

As is shown in FIG. 9, when the emissivities of the principal media that are used as the medium 2 were measured using a emissivity measuring instrument, the emissivities of the media were in a range of approximately 0.8 to approximately 0.95. Therefore, the emissivity of the detectable portion 4 is set to 0.7 or more and below 1. As a result of configuring in this manner, a emissivity difference, which is a difference between the emissivity of the detectable portion 4 and the emissivity of the medium 2, becomes within 0.1. If the emissivity difference is within 0.1, it is interpreted as a level that corresponds to within approximately three times in a case in which the emissivity difference is converted into a temperature difference, and at which there is not a problem in temperature control.

If the emissivity of the detectable portion 4 is set to 0.7 or more and 1 or less, it is possible to perform suitable control of the heater 40 with respect to media 2 such as an acrylic resin, a PET resin, a vinyl chloride resin, cloth and paper.

In addition, if the emissivity of the detectable portion 4 is set to 0.85 or more and 0.95 or less, it is possible to further reduce the emissivity difference with respect to media such as a PET resin, a vinyl chloride resin, cloth and paper. That is, if the emissivity of the detectable portion 4 is set to 0.85 or more and 0.95 or less, it becomes possible to suitably perform control of the heater 40 with respect to a portion of media.

In addition, if the emissivity of the detectable portion 4 is set to 0.9, it is possible to further reduce the emissivity difference with respect to a vinyl chloride resin medium 2. That is, if the emissivity of the detectable portion 4 is set to 0.9, it becomes possible to suitably perform control of the heater 40 with respect to a portion of media 2.

As a specific material of the detectable portion 4, in the present embodiment, an aluminum material to which an alumite treatment has been applied, is used. The emissivity of aluminum is considerably lower than that of the medium which is approximately 0.1, but by applying an alumite treatment to the surface thereof, it is possible to considerably increase the emissivity of the surface thereof. More specifically, it is possible to increase the emissivity of aluminum from approximately 0.1 to approximately 0.9 using the alumite treatment. Additionally, the alumite treatment itself may use a publicly-known treatment method.

Naturally, the embodiment is not limited to using this material as the material of the detectable portion 4, and it is possible to use a material that has a emissivity of 0.7 or more and below 1. It is also possible to use the medium as the material of the detectable portion 4.

In the present embodiment, since the emissivity of the detectable portion 4 is 0.7 or more and below 1, it becomes possible to handle temperature information that is obtained from the detectable portion 4 as temperature information that is obtained from the medium 2 in a practical sense when the sensor 72 obtains temperature information from the sensing point. As a result of this, since a state in which there is not a medium 2 at the sensing point attains substantially the same conditions as a state in which there is a medium 2 at the sensing point, it becomes possible to suitably control the output of the heater 40.

Additionally, in consideration of a time difference to when the medium 2 reaches the heat application range H of the heater 40, it is possible to set a setting temperature that makes a decision to initiate a recording operation due to the sensor 72 obtaining temperature information to approximately 90% of the original temperature, that is, to further reduce waste of the output of the heater 40 by performing setting at a slightly lower temperature.

In addition, as a result of the alumite treatment, it is possible to set such that a difference (the emissivity difference) between the emissivity of the detectable portion 4 and the emissivity of the medium 2 is within 0.1. Therefore, it becomes possible to suitably control the output of the heater using a simple method such as an alumite treatment while benefiting from the additional advantage of using a material with high strength such as aluminum metal as the downstream side support member 35.

In the abovementioned description, the detectable portion 4 is made from a viewpoint of being made from a material with which the emissivity of the detectable portion 4 becomes 0.7 or more and below 1. In place of this, it is possible to make the detectable portion 4 from a viewpoint of setting the difference between the emissivity of the detectable portion 4 and the emissivity of the medium 2 to be within 0.1. In this instance, the emissivity of the medium 2 may be determined by selecting a specific kind of medium, or alternatively, a plurality of media with high frequencies of usage may be selected, and an average value thereof may be used.

By setting so that the difference between the emissivity of the detectable portion 4 and the emissivity of the medium 2 is within 0.1, it is possible to handle temperature information that the sensor 72 obtains from the detectable portion 4 as temperature information that is obtained from the medium 2 in a practical sense. As a result of this, since a state in which there is not a medium 2 at the sensing point attains substantially the same conditions as a state in which there is a medium 2 at the sensing point, it becomes possible to suitably control the output of the heater 40.

Explanation 1 of Structure of Detectable Portion

As is shown in FIG. 6, in the present embodiment, the detectable portion 4 is positioned on a side that is opposite the heater 40 with respect to an apertured flat surface 7 that makes the opening portion 3. That is, the detectable portion 4 is provided in a position which is in the medium support unit 32 and does not configure the support surface 11 of the medium support unit 32. In addition, the opening portion 3 is provided in the mesh that forms the support surface 11.

More specifically, the detectable portion 4 is provided in the following manner.

The detectable portion 4 is made from a thin sheet aluminum material with a thickness of approximately 0.5 mm, and a base end portion 4E on the downstream side in the transport direction F in the detectable portion 4 is fixed to a base plate 8 through the fastening of a screw 6.

A surface 4F of a main body portion 4B on the upstream side of the base end portion 4E is a portion that is sensed by the infrared sensor 72. The surface 4F of the main body portion 4B is formed by being bent so as to move toward the apertured flat surface 7 with respect to the base end portion 4E. As described above, the alumite treatment is carried out on the surface 4F. A leading end portion 4S of the main body portion 4B is pushed against and is in contact with the base plate 8 in a state of having a free end.

In FIG. 4 and FIG. 5, the symbol 12 shows a reflective plate of the infrared heater 40, the symbol 13 shows an infrared heater pipe, and the symbol 14 shows a ventilation unit that blows air.

In FIG. 4, the display of a portion of the reflective plate 12 has been omitted so that the infrared heater pipe 13 can be seen.

The ventilation unit 14 is a unit for blowing air from the upstream side in the transport direction F to the downstream side thereof with respect to the heat application range H. As shown in FIG. 5, the ventilation unit 14 is provided in a position that is on an upper side in a height direction. More specifically, a position that is on an upper side is a position that is above the head 30 in the height direction. Additionally, the ventilation unit 14 has a role of promoting drying of the liquid L that is discharged onto the medium 2 by passing air so that the air comes into contact with the medium 2 of the heat application range H.

In addition, in a portion of the heat application range H in which the head 30 is present on the upper side thereof, the passage of air that is sent from the ventilation unit 14 is disturbed. Therefore, it is possible to reduce the generation of the shifting of landing positions of the liquid L that is discharged from the head 30 and the like that is caused by the ventilation. In this instance, the passage of air being disturbed refers to the fact that either all of the air is blocked, or that the air flow is reduced. Additionally, as long as the ventilation unit 14 is a component that blows air onto the heat application range H However, the installation location, and number of the ventilation unit 14, and the orientation of the air may be any orientation. For example, the ventilation unit 14 may be set to a configuration that blows air from the downstream side in the transport direction F toward the upstream side.

An arrangement structure in which the detectable portion 4 is positioned on a side that is opposite to the heater 40 with respect to the apertured flat surface 7 that forms the opening portion 3 is effective in a case in which the downstream side support member 35 (the medium support unit 32) has a structure that has small openings that steam can pass through in a front/rear direction with a mesh structure, a porous structure or the like. The reason for this is as follows.

Since it is possible for steam, which is generated from the ink (the liquid L) by the application of heat, to be rapidly separated from a rear surface of the medium 2 through the small openings of the downstream side support member 35, that is, the mesh that forms the support surface 11, there is little concern of the generation of condensation in a portion of the support surface 11. Meanwhile, there is a concern that condensation will be generated by the heat characteristics of a material that forms the detectable portion 4 in a case in which the detectable portion 4 supports the medium 2 by being in contact with the medium 2.

According to the present embodiment, since the detectable portion 4 is provided in a position which is in the medium support unit 32 and does not configure the support surface 11 of the medium support unit 32, and therefore, is not in contact with the medium 2, it is possible to reduce a concern that the medium 2 will become stained in a case in which condensation is generated in a portion of the detectable portion 4.

Furthermore, in the present embodiment, two linear members 9 that regulate an approach of the medium 2 in a direction that the medium 2 is coming into contact with the detectable portion 4, is provided in the opening portion 3. The linear members 9 are arranged in substantially the same positions as the apertured flat surface 7. Both end portions in the transport direction F of the linear members 9 are bent and locked to the base plate 8. Additionally, a number of linear members 9 is not limited to two, and may be one, or may be three or more. Stainless steel is used as the material of the linear members 9, but other material may also be used.

In the present embodiment, due to the presence of the linear members 9, it is possible to reduce a concern that the medium 2 will approach and become caught in the opening portion 3. Additionally, even if the linear members 9 are provided in the opening portion 3, since the linear members 9 are linear, there is little concern of the sensing precision of the infrared sensor 72 being reduced.

Explanation 2 of Structure of Detectable Portion

In place of the arrangement structure of the detectable portion 4 that is shown in FIG. 6, the detectable portion 4 may be provided so as to become flush with the apertured flat surface 7 that forms the opening portion 3. That is, the detectable portion 4 may be provided so as to configure a portion of the support surface 11.

In this instance, the detectable portion 4 being flush with the apertured flat surface 7 that forms the opening portion 3 refers to the fact that a portion of the detectable portion 4 that is sensed is flush with the apertured flat surface 7. Therefore, this is regardless of the positions of other constituent portions that configure the detectable portion 4. Additionally, naturally, the other constituent portions do not protrude beyond the apertured flat surface 7.

In the present embodiment, since, due to the flush structure, the position of the detectable portion 4 is substantially the same position as the position of the medium 2, in a positional sense, it is possible to sense with the same conditions as the medium 2. In addition, since the detectable portion 4 is flush with the apertured flat surface 7, it is possible to reduce a concern that the medium 2 will approach and become caught in the opening portion 3.

Other Forms of Opening Portion

In the form that is shown by FIG. 4, the opening portion 3 is rectangular, but the opening portion 3 may be a different form.

Figure 7:
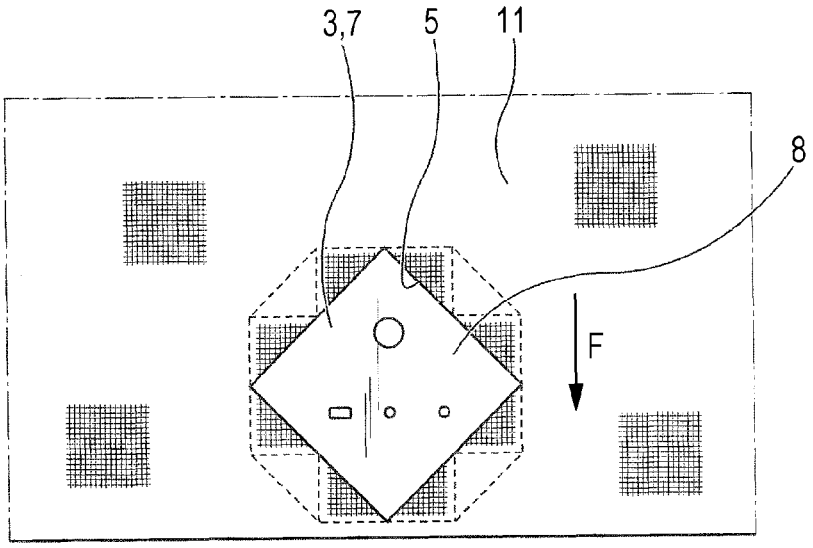
FIG. 7 is a perspective view that shows an example of an opening portion of the same embodiment as above.
Figure 8:
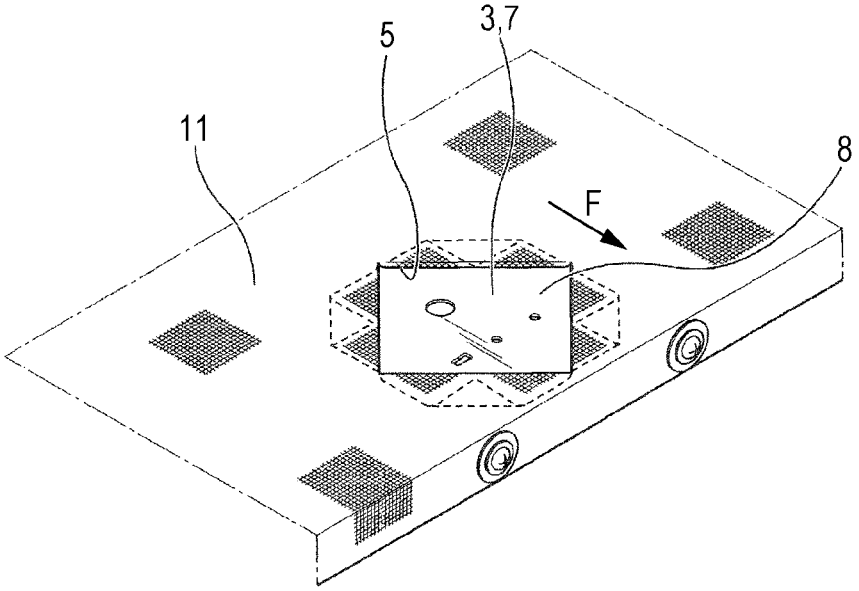
FIG. 8 is a perspective view in which the viewing angle of FIG. 7 has been changed.

As different forms, it is possible to include opening portions 3 such as those shown in FIG. 7 and FIG. 8 as examples. The opening portion 3 is configured to be a shape in which a length of a side in a direction that runs along the transport direction F of the medium 2 is 5 mm or less. That is, the length in the direction that runs along the transport direction F is formed to be short. As a result of this, it is possible to control a circumstance in which lines are formed on a printed object (for example, an image) that is formed on the medium 2. In other words, the length of the opening portion 3 in the direction that runs along the transport direction F of the medium 2 may be formed to be short to an extent that lines are not formed on a printed object that is formed on the medium 2.

In addition, in the present embodiment, the opening portion 3 is configured to be a shape in which a length of a side in a direction that is orthogonal to the transport direction F of the medium 2 is 5 mm or less. That is, the length of a side in the direction that is orthogonal to the transport direction F is formed to be short. As a result of this, it is possible to reduce a concern that the medium 2 will become caught in the opening portion 3 during transport of the medium 2. In other words, the length of the side of the opening portion 3 in the direction that is orthogonal to the transport direction F of the medium 2 may be formed to be short to an extent that the medium 2 does not become caught in the opening portion 3 during transport of the medium.

In the present embodiment, the opening portion 3 is formed to be a diamond shape, but is not limited to this shape. An elliptical shape or a circular shape may be used. As long as the opening portion 3 forms a shape in which the length of a side in a direction that runs along the transport direction F is 5 mm or less, and the length of a side in a direction that is orthogonal to the transport direction F is 5 mm or less, it is possible to reduce a concern that the medium 2 will become caught in the opening portion 3 during transport of the medium 2 while suppressing the formation of lines on a printed object (for example, an image) that is formed on the medium 2. However, among the conditions of the length of a side in a direction that runs along the transport direction F being 5 mm or less, and the length of a side in a direction that is orthogonal to the transport direction F being 5 mm or less, a shape that only satisfies either one of the conditions may be used.

Furthermore, in the present embodiment, the opening portion 3 is formed by bending a portion of the mesh that forms the support surface 11 of the medium support unit 32 in the form of a mountain fold when viewed from a side that supports the medium 2. As a result of this, it is possible to make the edges of the opening portion 3 smooth, and therefore, it is possible to reduce a concern that a medium 2 that is transported will become caught at the edge of the opening portion 3.

It is desirable that the mountain fold be made by folding two or more times. The reason for this is that, as a result of this configuration, it is possible to reduce a concern that a leading end of the folded portion will be enclosed in an internal portion and protrude from the support surface 11.

Other Embodiments

The abovementioned embodiments are intended to simplify the understanding of the invention, and should not be interpreted in a manner that limits the invention. Needless to say, in addition to various alterations and improvements that do not depart from the scope of the invention being possible, the equivalents of such changes are included in the invention. In particular, the embodiments that are described below are also included in the invention.

In the abovementioned embodiment, a liquid discharging apparatus was embodied as an ink jet printer, but a liquid discharging apparatus that ejects or discharges a liquid other than ink can be adopted, and it is possible to adopt the invention in various liquid ejecting apparatuses that are provided with liquid discharge heads that discharge minute amounts of liquid droplets or the like. Additionally, liquid droplets refer to the state of liquid that is discharged from the abovementioned liquid discharging apparatuses, and may include droplets that leave a trail in a granular form, a tear form or a string form.

In addition, the liquid that is referred to here may be any material that a liquid discharging apparatus can eject. For example, the liquid may be any substance that is in a state in which it is in the liquid phase, and may include liquids in which particles of organic material that are formed from solid matter such as pigment or metal particles are dissolved, dispersed, or mixed into a solvent in addition to liquid states with high or low viscosities, fluid states such as sols, gel waters, other inorganic solvents, organic solvents, liquid solutions, liquid resins, liquid metals (metallic melts) or substances in a single state. In addition, an ink, liquid crystal or the like such as that described in the abovementioned embodiment can be given as a representative example of the liquid.

In this case, ink can include various liquid compositions such as a general water-based ink or oil-based ink, a gel ink, or a hot melt ink. As a specific example of a liquid discharging apparatus, for example, it is possible to use liquid discharging apparatuses that eject liquids that include materials such as electrode materials and color materials, which are used in the manufacturing of liquid crystal displays, EL (electroluminescence) displays, surface-emitting displays, color filters and the like in a dispersed or dissolved form, liquid discharging apparatuses that eject living organic material that is used in the manufacture of biochips, or liquid discharging apparatuses, printing equipment, microdispensers or the like that eject liquids that form specimens that are used as precision pipettes. Furthermore, it is possible to adopt a liquid discharging apparatus that ejects a lubricating oil with pinpoint precision in a precision instrument such as a watch or a camera, a liquid discharging apparatus that ejects a transparent resin liquid such as an ultraviolet curable resin for forming a microhemispherical lens (an optical lens) or the like that is used in optical communication elements or the like onto a substrate, or a liquid discharging apparatus that ejects an etching liquid such as an acid or an alkali for etching a substrate or the like. Further, it is possible to adopt the invention in any one of these various ejecting apparatuses.

In addition, the ink of the present embodiment may include a resin emulsion. A resin emulsion exhibits an effect that causes favorable abrasion resistance in an image by sufficiently attaching a coloring ink to a target recording medium due to the formation of a resin coating in addition to preferably a wax (an emulsion) when heat is applied to the target recording medium. As a result of the abovementioned effect, recorded objects that are recorded using coloring ink that contains a resin emulsion have superior abrasion resistance on target recording materials that do not absorb or a poor absorbers of ink in particular.

Although not limited to these, for example, single polymers or copolymers of (meth) acrylic acid, (meth) acrylic acid ester, acrylonitrile, cyanoacrylate, acrylamide, olefin, styrene, vinyl acetate, vinyl chloride, vinyl alcohol, vinyl ether, vinylpyrrolidone, vinyl pyridine, vinylcarbazole, vinyl imidazole and vinylidene chloride, fluorine resins and natural resins can be given as examples of resin emulsions. Among these, at least either one of a (meth) acrylic resin and a (meth) acrylic acid copolymer resin is preferable, at least either one of an acrylic resin and a styrene-acrylic acid copolymer resin is more preferable, and a styrene-acrylic acid copolymer resin is still more preferable. Additionally, the abovementioned copolymers may be any form including a random copolymer, a block copolymer, an alternating copolymer and a graft copolymer.

In addition, in the present embodiment, the transport unit 20 was configured to have the first transport roller 23 that is positioned further on the upstream side of the transport direction than the head 30, and the second transport roller 24 that is positioned further on the downstream side of the transport direction than the head 30, but the number of transport rollers and the arrangement thereof is not limited to this configuration.

In addition, in the present embodiment, an example that used a roll-shaped medium 2 as an example of the medium was given, but the medium 2 may be single sheets of medium. In a case in which the medium 2 is single sheets of medium, there is a high probability that a state in which the medium 2 are not positioned on the downstream side support member 35 at the start of recording. However, it is desirable that the energy of the heater 40 already be an (suitable) irradiation energy that sets the medium 2 to a predetermined temperature at the start of recording. If the invention is used, control of the heater 40 is even able to be suitably performed in a case in which the medium 2 is single sheets of medium.

In addition, in the present embodiment, an example in which an infrared sensor 72 is used as the sensor is given, but other sensors may be used. As long as the sensor detects electromagnetic waves that are emitted from the surface of the medium 2, sensors that detect ultraviolet rays, microwaves or the like may be used. Among these, in the object of estimating the temperature of the medium, the use of an infrared sensor is more effective. Additionally, infrared rays refer to electromagnetic waves in a wavelength region of approximately 0.7 μm to 1000 μm. Among the wavelength region of approximately 0.7 μm to 1000 μm, the infrared sensor 72 may be a sensor that detects electromagnetic waves in a wavelength region of at least a portion thereof.

In addition, the size of a sensing area that the infrared sensor 72 senses is variable, and the size of the sensing area may be changed as a result of a first state in which the medium 2 is at the sensing point and a second state in which the medium 2 is not at the sensing point. In other words, the size of the sensing area changes as a result of a case in which the infrared sensor 72 senses the detectable portion and a case in which the sensor senses the medium 2 that is supported by the medium support unit 32.

That is, a sensor in which it is possible to change the size of the sensing area thereof is prepared, and in the second state in which the detectable portion 4 is sensed, the control unit 60 controls the size of sensing area so as to be established within the detectable portion 4 (smaller).

On the other hand, in the first state in which the surface of the medium 2 is sensed, since it is not necessary to establish the sensing area inside the detectable portion 4, with the aim of improving the uniformity of sensing results by sensing a wide area with the sensor, the size of sensing area is set to be larger than during the second state (it is preferable that the size be set to the maximum).

Further, if configured in this manner, since it becomes possible to suitably exhibit the ability of the sensor, it is possible to realize further suitable control of the heater.

The entire disclosure of Japanese Patent Application No. 2014-006936, filed Jan. 17, 2014 is expressly incorporated reference herein.

What is claimed is:

1. A liquid discharging apparatus comprising:

a discharge unit that is capable of discharging a liquid;

a medium support unit in which an opening portion is provided, and which supports a medium onto which the liquid is discharged;

a heater that is capable of applying heat to the medium;

a sensor that detects an energy in a detectable region;

a control unit that is capable of changing an output of the heater on the basis of the energy; and a detectable portion whose energy is detected by the sensor, and which is provided in a position that is within the opening portion such that the detectable portion is located below a surface of the support unit and is within the detectable region, wherein an emissivity of the detectable portion is higher than an emissivity of the medium support unit.

2. The liquid discharging apparatus according to claim 1, wherein a emissivity of the detectable portion is 0.7 or more and below 1.

3. The liquid discharging apparatus according to claim 1, wherein a difference between a emissivity of the detectable portion and a emissivity of the medium is within 0.1.

4. The liquid discharging apparatus according to claim 1, wherein the detectable portion is made of an aluminum to which an alumite treatment has been applied.

5. The liquid discharging apparatus according to claim 1, wherein the detectable portion is provided in a position which is in the medium support unit and does not configure a support surface of the medium support unit.

6. The liquid discharging apparatus according to claim 5, wherein a linear member that regulates an approach of the medium in a direction that the medium is coming into contact with the detectable portion, is provided in the opening portion.

7. The liquid discharging apparatus according to claim 1, wherein the medium is capable of being transported in a transport direction, and wherein a length of a side of the opening portion in a direction that runs along the transport direction of the medium is 5 mm or less.

8. The liquid discharging apparatus according to claim 1, wherein the medium is capable of being transported in a transport direction, and wherein a length of a side of the opening portion in a direction that is orthogonal to the transport direction of the medium is 5 mm or less.

9. The liquid discharging apparatus according to claim 7, wherein the opening portion is formed by bending a portion of the medium support unit in the form of a mountain fold when viewed from a side that supports the medium.

10. The liquid discharging apparatus according to claim 1, wherein there are a case in which the sensor detects an energy of the detectable portion, and a case in which the sensor detects an energy of the medium that is supported by the medium support unit.

11. A liquid discharging apparatus comprising:

a discharge unit that is capable of discharging a liquid;

a medium support unit in which an opening portion is provided, and which supports a medium onto which the liquid is discharged;

a heater that is capable of applying heat to the medium;

a sensor that detects an energy in a detectable region;

a control unit that is capable of changing an output of the heater on the basis of the energy; and a detectable portion whose energy is detected by the sensor, and which is provided in a position that is within the opening portion and is within the detectable region, wherein a size of the detectable region is variable, and wherein the size of the detectable region changes as a result of a case in which the sensor detects an energy of the detectable portion, and a case in which the sensor detects an energy of the medium that is supported by the medium support unit.

* * * * *